US006926462B1

(12) United States Patent
Fuganti et al.

(10) Patent No.: US 6,926,462 B1
(45) Date of Patent: Aug. 9, 2005

(54) RETRACTABLE ROAD BARRIER

(75) Inventors: Antonio Fuganti, Orbassano (IT); Silvano Sandri, Orbassano (IT); Mario Bochicchio, Orbassano (IT); Stefano Re Fiorentin, Orbassano (IT); Mario Palazzetti, Orbassano (IT); Salvatore Frediani, Orbassano (IT); Roberto Puppini, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 10/470,311

(22) PCT Filed: Nov. 19, 2002

(86) PCT No.: PCT/IB02/04834

§ 371 (c)(1),
(2), (4) Date: Jul. 29, 2003

(87) PCT Pub. No.: WO03/046289

PCT Pub. Date: Jun. 5, 2003

(30) Foreign Application Priority Data

Nov. 27, 2001 (IT) ..... TO2001A1105

(51) Int. Cl.[7] ..... E01F 13/00; E01F 13/04

(52) U.S. Cl. ..... 404/6; 404/9; 404/11; 256/13.1

(58) Field of Search ..... 404/6, 9, 10, 11; 256/13.1

(56) References Cited

U.S. PATENT DOCUMENTS

| | | | | |
|---|---|---|---|---|
| 3,807,699 | A * | 4/1974 | France | 256/13.1 |
| 4,332,503 | A * | 6/1982 | Hurst, Jr. | 404/11 |
| 4,490,068 | A * | 12/1984 | Dickinson | 404/6 |
| 4,916,859 | A * | 4/1990 | Butler | 49/9 |
| 4,998,843 | A * | 3/1991 | Mothe | 404/6 |
| 5,009,542 | A * | 4/1991 | Hardin et al. | 404/6 |
| 5,181,794 | A * | 1/1993 | Wilson et al. | 404/6 |
| 5,263,281 | A * | 11/1993 | Osborn | 49/280 |
| 5,464,177 | A * | 11/1995 | Kramer et al. | 246/127 |
| 5,498,100 | A * | 3/1996 | Guernsey | 404/6 |
| 5,551,796 | A * | 9/1996 | Anderson et al. | 404/6 |

FOREIGN PATENT DOCUMENTS

| | | |
|---|---|---|
| DE | 34 20 503 A | 12/1984 |
| FR | 2 750 148 A | 12/1997 |

* cited by examiner

*Primary Examiner*—Thomas B. Will
*Assistant Examiner*—Raymond W Addie
(74) *Attorney, Agent, or Firm*—Sughrue Mion, PLLC

(57) ABSTRACT

A safety barrier for road use comprises a barrier element which can be displaced between an operative position, above the road surface, and an inoperative position, in which it does not substantially project above the road surface. Preferably provided is a number of sets of aligned barrier elements, rigidly connected to one another, the adjacent sets being connected together by articulated connecting structures which enable one set of barrier elements to be displaced between its inoperative position and its operative position without modifying the positions of the adjacent sets. In this way, one or more stretches of the barrier can be brought into the inoperative condition, leaving the adjacent stretches of barrier in the normal operative condition.

5 Claims, 5 Drawing Sheets

RETRACTABLE ROAD BARRIER

This is a National Stage Entry of Application No. PCT/IB02/04834 filed Nov. 19, 2002; the disclosure of which is incorporated herein by reference.

BACKGROUND OF THE INVENTION

The present invention relates to safety barriers for road use of the type comprising at least one barrier element and a supporting structure for supporting the barrier element, provided with means for anchoring thereof to the ground, wherein said supporting structure is movable between a first position, in which the barrier element is in an operative position above the road surface, and a second position, in which the barrier element is in an inoperative position in which it does not substantially project above the road surface, wherein in said inoperative condition the barrier element is received inside a trench formed in the road surface, wherein the supporting structure includes at least one supporting column articulated at one of its ends to a bracket for anchorage to the ground and, at the opposite end, to the barrier element, said supporting column being pivotable between an operative upright position and an inoperative lowered position, and in which means are provided for controlling rotation of said supporting column.

A road barrier of the above indicated type is disclosed in document DE-A-34 20 503. In this known solution, more barrier elements are provided which, when in the lowered position, are spaced apart from each other, so that free spaces are defined therebetween which require the provision of additional platforms in order to cover the trench which receives the barrier elements in the lowered condition. Moreover, in this known solution, in case only some of the barrier elements are lowered into the inoperative position, interruptions are formed at the areas interposed between each lowered element and an adjacent raised element. Finally, the solution shown in the above indicated document has a structure such that any operations for replacing a damaged barrier portion, for example due to a road accident, become lengthy and troublesome.

The same drawbacks are encountered also in the barrier shown in document FR-A-2 750 148. In particular, although this solution shows a barrier with a connecting element which connects a retractable barrier element to a non-retractable barrier element, it does not provide for a connecting element between two barrier elements which are both retractable, so that there are not ample possibilities to choose the barrier portion which one wishes to retract. Furthermore, the barrier of this second known solution does not ensure a continuous surface both above and on the two sides of the barrier and moreover it has columns for supporting the retractable element which are directly articulated to the walls of the trench in which the retracted element is received, so that any operations for replacing a damaged barrier element are lengthy and costly.

SUMMARY OF THE INVENTION

The object of the present invention is that of providing a road barrier which is able to overcome all the above mentioned drawbacks.

In view of achieving this object, the invention provides a road barrier having all the features which have been indicated at the beginning of the present description and further characterized in that said safety barrier comprises a succession of sets of one or more barrier elements, the barrier elements of each set being rigidly connected to each other, and adjacent sets of barrier elements being connected to each other by means of articulated connecting elements having variable length, which enable a relative displacement in a vertical direction of any set with respect to the other, while always defining a continuous upper surface and two side continuous side surfaces of the barrier in any position of any set of barrier elements of the barrier.

Due to the above indicated features, there exists an ample flexibility in the configurations which can be selected for the barrier, since any one of the sets of barrier elements can be displaced from the operative raised position to the lowered inoperative position, while the sets adjacent to the ends of the lowered set can be either kept raised or lowered, at will, the connecting elements between adjacent sets ensuring the continuity of the upper surface and the two side surfaces of the barrier in any case. Furthermore, since each set of barrier elements is constituted by barrier elements whose supporting columns are articulated to a bracket which is anchored to the ground, each of these sets forms a unit which can be easily removed and replaced.

A further object of the present invention is that of ensuring that the barrier elements can be all moved to their lowered position even in case of an absence of the electric main supply, which condition may well take place in case of an accident, or in case of a fire inside the tunnel.

In view of efficiently solving this problem, the barrier according to the invention is further characterized in that a solenoid valve is provided which can be activated in order to put a cylinder for raising the barrier element in a discharge condition, in order to cause lowering of the respective barrier element, and in that emergency electric supply means are provided for activating said solenoid valve in case of a failure in the main supply of electric current. In this manner, in any situation of emergency in which the electric main supply has been interrupted, it is possible to cause an automatic lowering of the barrier elements to their retracted position.

BRIEF DESCRIPTION OF THE DRAWINGS

Further characteristics and advantages of the present invention will emerge from the ensuing description, with reference to the attached drawings, which are provided purely by way of non-limiting example and in which.

DETAILED DESCRIPTION OF THE INVENTION

Figure 1:
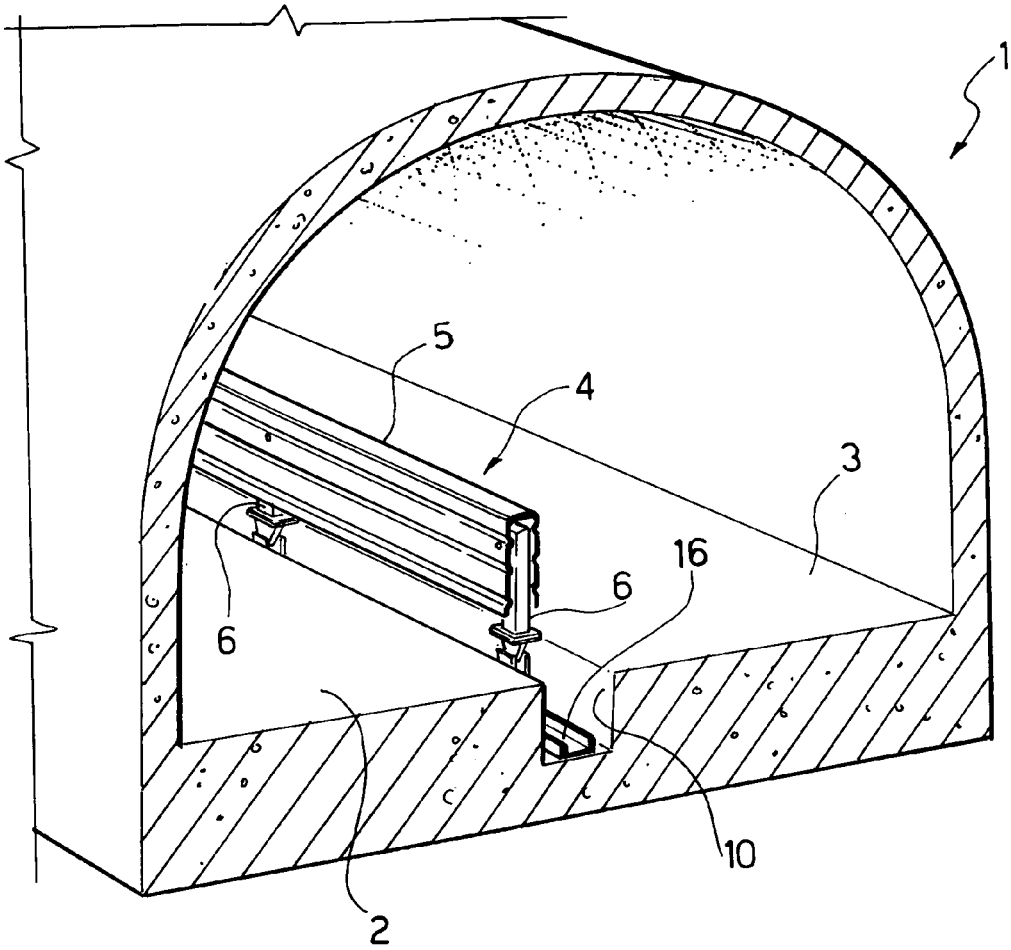
FIG. 1 is a schematic view illustrating a road tunnel in which the two traffic lanes (in opposite directions) for motor vehicles are divided by a safety barrier according to the invention.

In FIG. 1, the reference number 1 designates as a whole a road tunnel having two lanes 2, 3 for passage of traffic in two opposite directions, which are separated by a safety barrier 4 built according to the invention.

Figure 2:
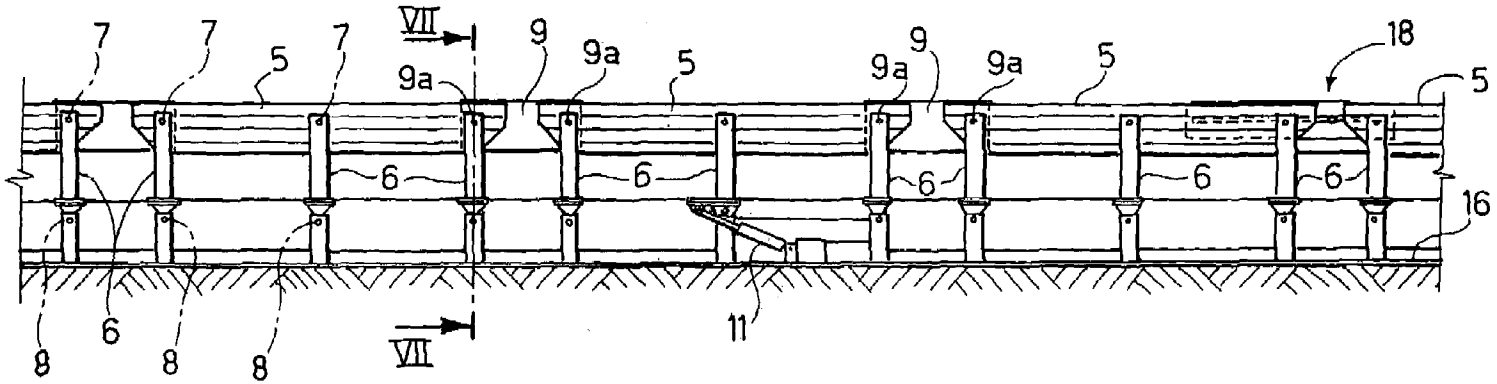
FIG. 2 is a side elevation of one portion of the safety barrier of FIG. 1 in its operative condition.

The barrier 4 comprises an aligned succession of barrier elements 5 consisting of metal channel section with reversed-U cross section and undulations for stiffening, if so required, the said barrier elements being each carried by a set of three supporting columns 6. Each column 6 has one end articulated in 7 (FIG. 2) to the respective barrier element 5, and the opposite end articulated in 8 to an attachment element anchored to the ground.

Figure 3:
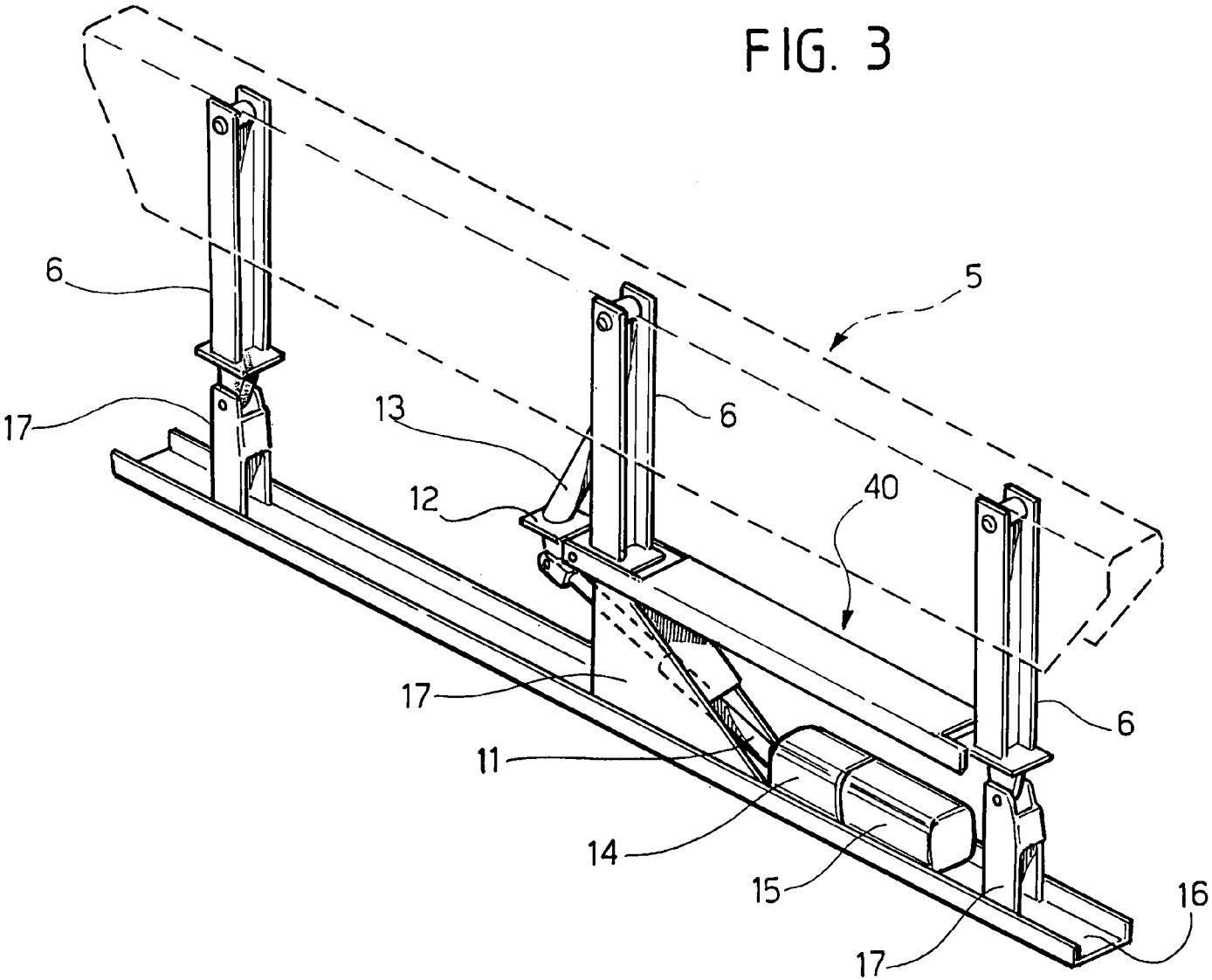
FIG. 3 is a perspective view of an element of the barrier of FIGS. 1 and 2 in its operative condition.
Figure 7:
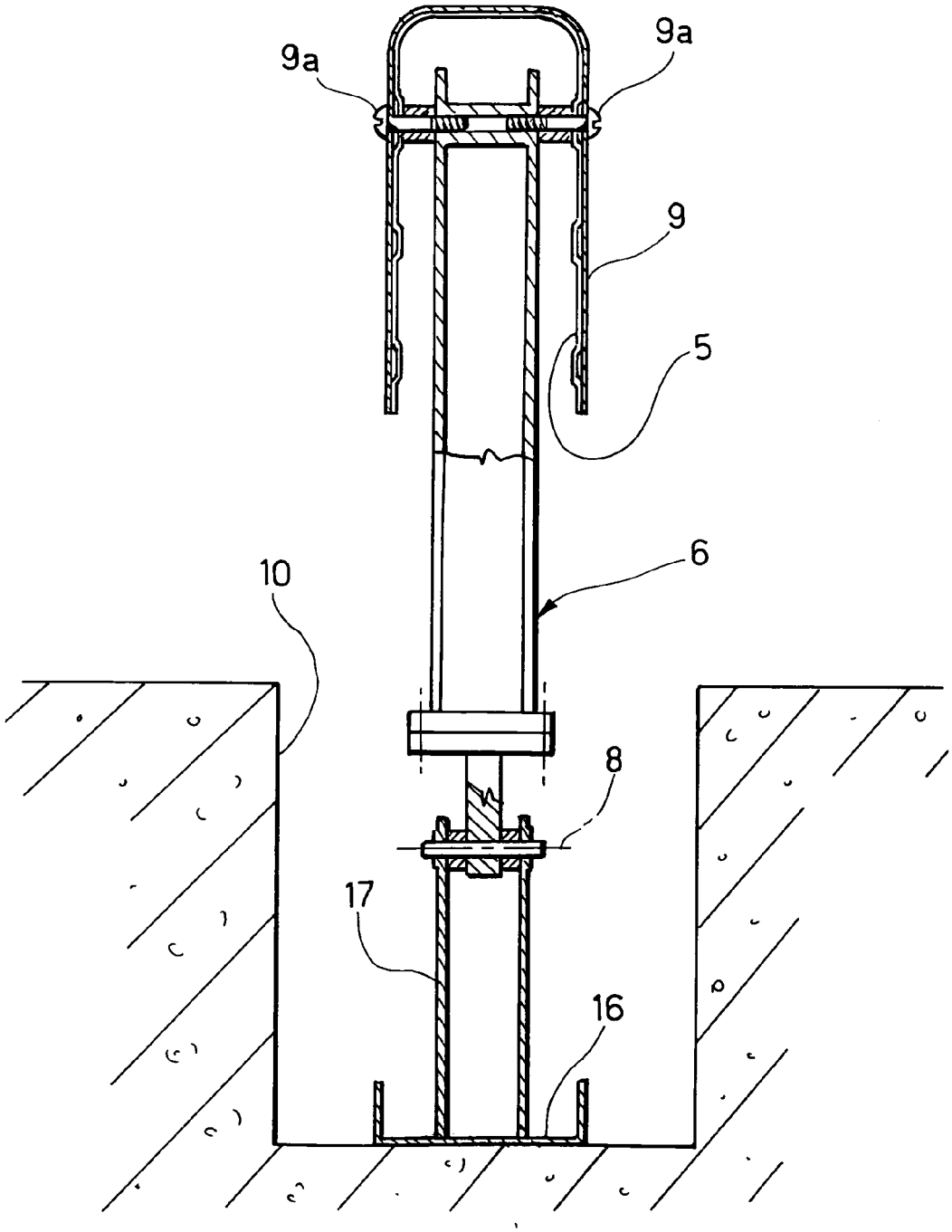
FIG. 7 is a sectional view taken along the line VII—VII of FIG. 6.

The barrier elements 5 are rigidly connected together in sets of a number of elements (for example, three) by connecting elements 9 consisting of reversed-U channel section, which are set on top of one other and are bolted by means of screws 9*a* (see FIG. 7) to the barrier elements 5. The ensemble consisting of three barrier elements 5 making up each set can be displaced between its normal operating position, in which it projects above the road surface (FIG. 2), and a lowered, inoperative, position, which is reached by means of simultaneous rotation downwards of the columns 6 about their respective bottom articulations 8 and in which the barrier elements 5 disappear inside a trench 10 made in the road surface. The movement of the barrier elements 5 between an inoperative position and the operative position is controlled, for each set of three barrier elements 5 connected rigidly together by the connecting elements 9, by a single hydraulic cylinder 11 having one end articulated to the ground and the opposite end articulated to a bracket 12 (FIG. 3) of the central column 6 of the set of three columns 6 associated to the central barrier element 5 of the set of three barrier elements 5 rigidly connected together. For stiffening purposes, the said central column 6 is provided with a bracing arm 13. A plate 40 is set between each pair of adjacent columns 6 (only one plate 40 being illustrated), which has both a stiffening function and the function of partially closing the trench 10 when the barrier is raised. The hydraulic cylinder 11 is supplied by a pump 14 which is controlled by an electric motor 15, the assembly consisting of the motor 15 and the pump 14 being mounted inside a channel 16 (FIG. 3) anchored to the ground. Fixed to the said channel are also the attachments 17 which are provided in the trench 10 (see also FIG. 7). In this way, the entire module consisting of the channel 16 and all the components illustrated in FIG. 3 can be readily and quickly replaced.

The system is provided with means for automatic control of lowering of the barrier in the event of failure of electric power supply (as in the case of an accident in a tunnel). For example, a 12-V emergency electric power generator may be envisaged which drives a solenoid valve that controls the cylinder.

Figure 4:
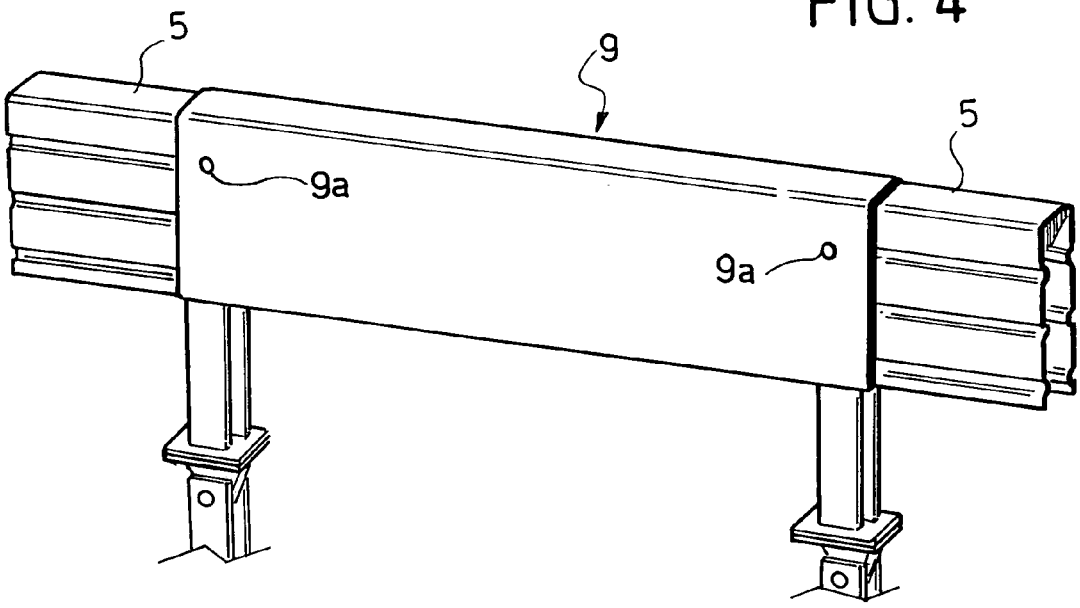
FIG. 4 illustrates a connecting element which rigidly connects two barrier elements adjacent to one another.
Figure 5:
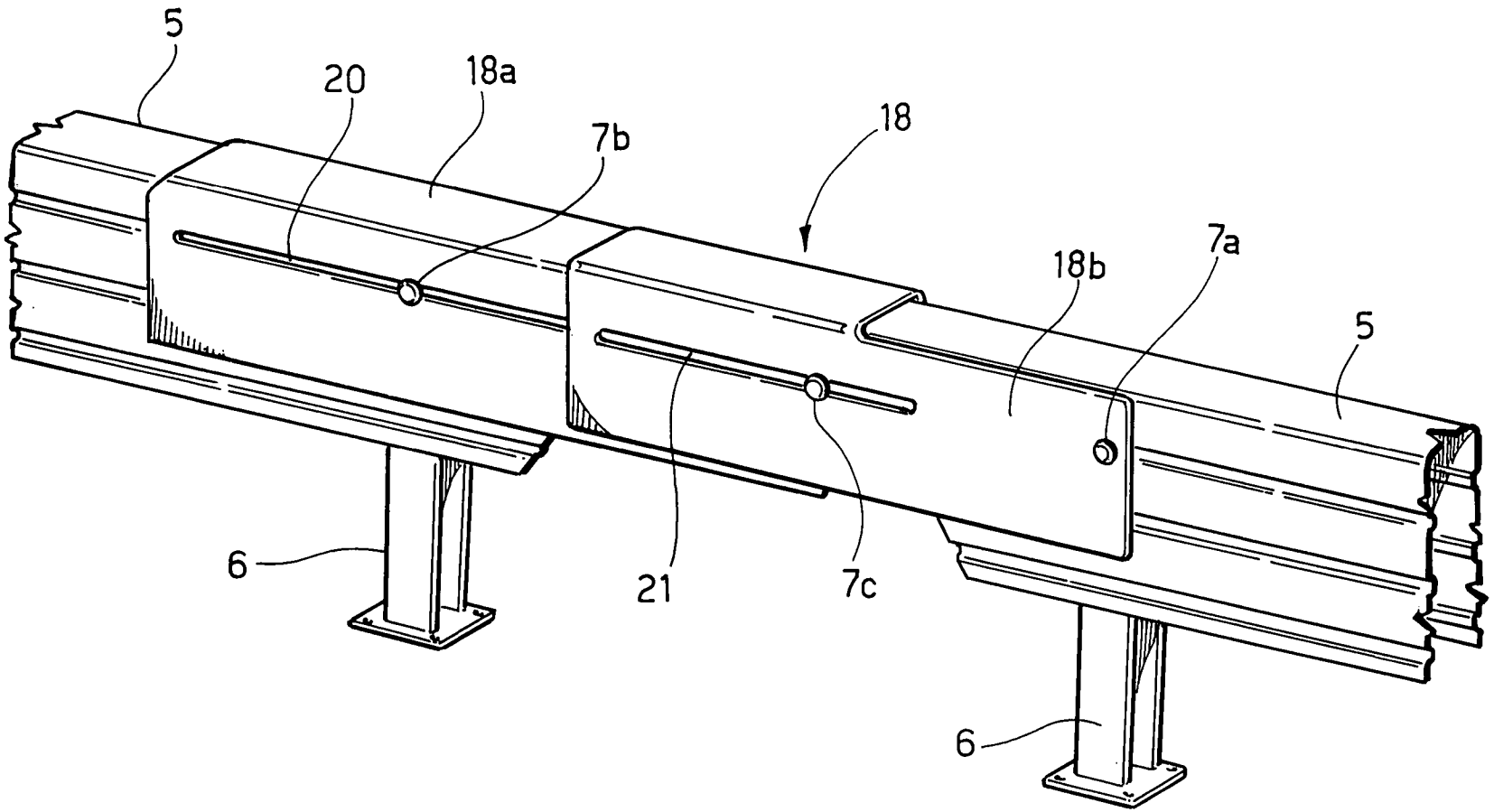
FIG. 5 is a perspective view of an articulated connecting element which connects together two sets of barrier elements in such a way as to enable movement of one set with respect to the other.

FIG. 4 is a perspective view which clearly illustrates the connecting element 9 that rigidly joins barrier elements 5 to form a set of three elements. FIG. 5 is a perspective view illustrating a connecting structure 18 which is set between two adjacent sets of three barrier elements 5. The structure 18 comprises two portions of channel section 18*a*, 18*b* which are articulated in 7*a*, 7*b* to two adjacent columns 6 (see FIG. 6) and which are moreover connected together in an articulated way by means of transverse pins 7*c*. The articulation in 7*b* is obtained by engagement of the side pins in side slits made in the sides of the respective barrier element 5. The articulation 7*c* is also obtained by means of side pins which engage both the slits 20 made in the element 18*a* and the slits 21 made in the element 18*b*.

Figure 6:
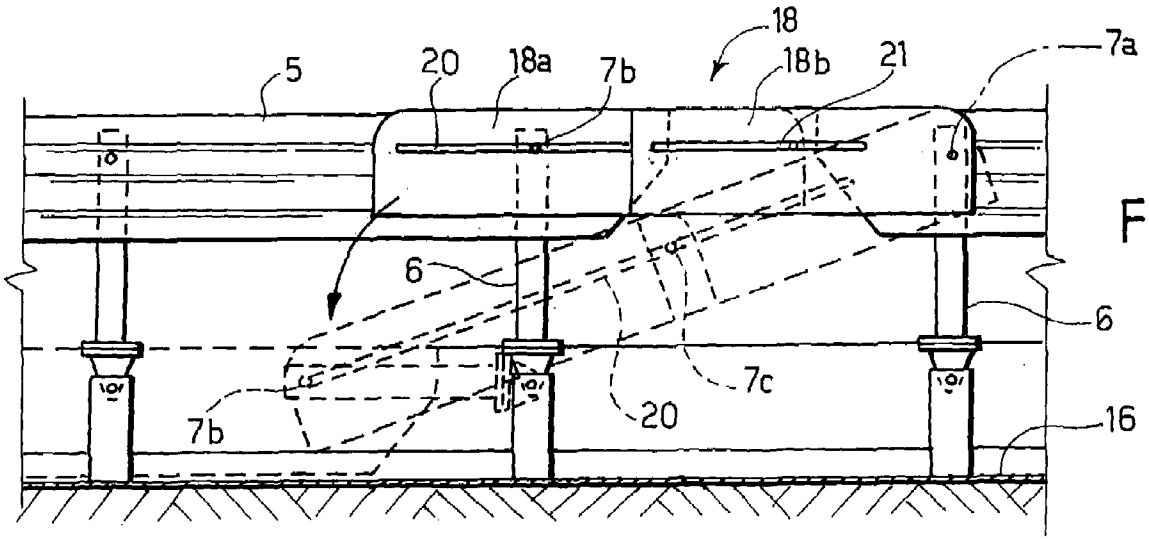
FIG. 6 is a schematic side view which shows a connecting element between two different sets of barrier elements in two different operating conditions.

Thanks to the arrangement described above, when the set of three barrier elements 5 that is on the left, with reference to FIG. 6, is lowered, with respect to the set of three elements that is on the right-hand side, the connecting structure 18 moves from the condition illustrated with a solid line to the condition illustrated with a dashed line. In this way, continuity of the barrier is ensured, and at the same time the possibility is guaranteed for just a few portions of the barrier to be lowered into the inoperative position, leaving the remaining portions in the normal operating condition.

According to a further important feature of the invention, the fluid cylinder is of the single effect type, which causes raising of the respective barrier element when it is supplied with fluid under pressure, whereas it automatically returns to the condition corresponding to the lowering of the barrier element when its hydraulic chamber is connected to discharge. According to the invention, this chamber of the fluid cylinder can be connected to a discharge by means of a solenoid valve which can be activated by an emergency electric supply (such as a backup battery, or an emergency electric generator) in case the main supply is interrupted following an emergency situation such as in case of a fire within the tunnel. The barrier according to the invention is thus able to provide a high degree of safety since it is automatically brought to the retracted condition in the above described emergency situations.

Finally, the elements of the barrier can also be used to carry an optical guide. For instance, inside some or all the barrier elements it is possible to provide a duct made of transparent plastic material (such as polycarbon) with a OLF film provided inside the duct, a light source at one end, for example constituted by a plurality of LED devices, and a closing cover at the opposite end with a reflective film. The LED light source is supplied with a low voltage direct current and offers a high degree of safety in the system as well as a low energy consumption. The use of this optical guide enables the forwarding of coloured light signals, if necessary intermittent, which are controlled by an electronic control unit and have the purpose for instance of signalling the proper safety spacing between each vehicle and the subsequent one, the safety speed and the stop areas for the vehicles which travel through the tunnel.

From the foregoing description it is evident that the idea underlying the invention is to provide a safety barrier that can be quickly brought into an inoperative condition in which it does not project above the road surface, with the consequent advantages that have been mentioned at the beginning of the present description. Of course, the structure and arrangement of the barrier elements that have been illustrated herein by way of example could be altogether different. The same applies to the devices used for controlling movement of the barrier elements. A further preferred characteristic of the invention lies in the characteristic described previously, which regards the possibility of displacing only one portion of the barrier between the operative position and the inoperative position, without changing the positions of the adjacent portions. In addition, without prejudice to the principle of the invention, the details of construction and the embodiments may vary widely with respect to what is described and illustrated herein purely by way of example, without thereby departing from the scope of the present invention.

For example, It would also be possible that each lowerable barrier unit comprises a single barrier element.

What is claimed is:

1. A safety barrier for road use, comprising:

at least one barrier element, and a supporting structure for supporting at least one barrier element, provided with means for anchoring thereof to the ground, wherein said supporting structure is displaceable between a first position, in which at least one barrier element is in an operative condition above the road surface, and a second position, in which at least one barrier element is in an inoperative condition in which it does not substantially project above the road surface, wherein, in said inoperative condition, at least one barrier element is received inside a trench formed in the road surface, wherein the supporting structure includes at least one supporting column articulated at one of its ends to a bracket for anchorage to the ground and, at the opposite end, to at least one barrier element; said supporting column pivotable between an upright operative position and a lowered inoperative position, wherein means are provided for controlling rotation of said supporting column, wherein said safety barrier comprises a succession of sets of one or more barrier elements, the elements of each set being rigidly connected to each other and adjacent sets being connected to each other by means of articulated connecting elements having a variable length, which enable a relative displacement in the vertical direction of one set relative to the other, while always defining a continuous upper surface and two continuous side surfaces for the barrier in any position of any set of the barrier, and wherein said barrier element and said articulated connecting elements are in form of metal profiles having a cross-section in form of an inverted U, each having an upper wall and two side walls extending through a substantial portion of the height of said supporting columns.

2. Barrier according to claim 1, characterized in that said means for controlling rotation of said supporting column include a fluid cylinder, a solenoid valve for connecting said fluid cylinder to a discharge, in order to cause lowering of the respective barrier element in its retracted position, and emergency electric supply means for activating said solenoid valve in case of an interruption of the electric main supply.

3. Barrier according to claim 2, characterized in that said means for activating the solenoid valve are able to become automatically operative in case of an interruption of electric main supply.

4. Barrier according to claim 1, characterized in that an optical guide is associated to one or more elements of the barrier.

5. Barrier according to claim 1, characterized in that an optical guide is associated to one or more elements of the barrier.

* * * * *